US005790748A

United States Patent [19]

Tamhane

[11] Patent Number: 5,790,748

[45] Date of Patent: Aug. 4, 1998

[54] FORCED AIR BASEBOARD HEATER WITH PIVOTABLY MOUNTED FANS

[76] Inventor: Ashok Y. Tamhane, 94 Joanne Dr., Holbrook, N.Y. 11741

[21] Appl. No.: 674,250

[22] Filed: Jul. 1, 1996

[51] Int. Cl.[6] ..... F24H 3/00

[52] U.S. Cl. ..... 392/366; 392/352; 392/367; 167/57; D23/380; D23/389

[58] Field of Search ..... 392/366, 352, 392/353, 356, 358, 370, 367, 363, 360; 237/70, 79; 454/288, 287; D23/380, 389; 165/122, 53, 56, 57

[56] References Cited

U.S. PATENT DOCUMENTS

| | | | |
|---|---|---|---|
| 1,627,229 | 5/1927 | Brown | 392/363 |
| 1,884,094 | 10/1932 | Modine | 165/57 |
| 3,151,671 | 10/1964 | Kritzer | 237/79 |
| 3,259,053 | 7/1966 | Steel | 392/366 |
| 3,277,275 | 10/1966 | Brusven | 392/363 |
| 3,829,010 | 8/1974 | Jones | 236/49 |
| 4,809,593 | 3/1989 | Asselbergs | 236/49 |
| 5,121,788 | 6/1992 | Carollo | 165/47 |
| 5,226,592 | 7/1993 | Turner | 237/79 |
| 5,245,691 | 9/1993 | Wu | 392/365 |

FOREIGN PATENT DOCUMENTS

| | | | |
|---|---|---|---|
| 936794 | 7/1948 | France | 392/360 |
| 549038 | 4/1932 | Germany | 392/363 |
| 2652880 | 6/1977 | Germany | 392/363 |

*Primary Examiner*—John A. Jeffery

[57] ABSTRACT

A heater for heating and dispensing air within a room. the inventive device includes a heater having a heating coil or radiator located within a housing. Fan assemblies are mounted to end panels and/or front panels of the housing to force air through the heater and into a room.

15 Claims, 3 Drawing Sheets

FIG 1
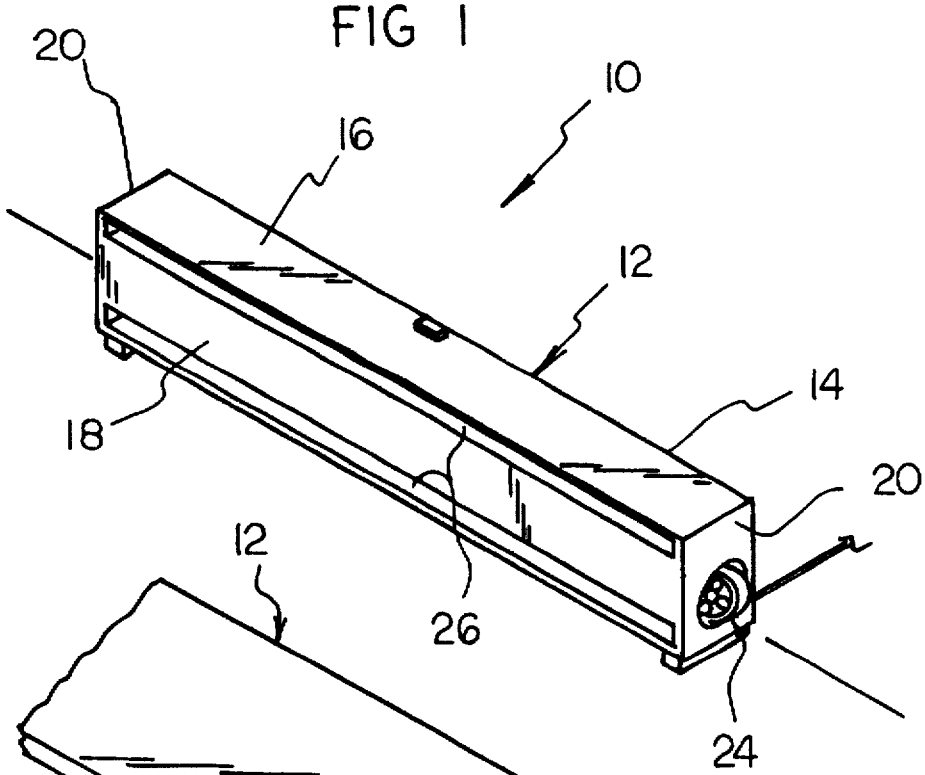
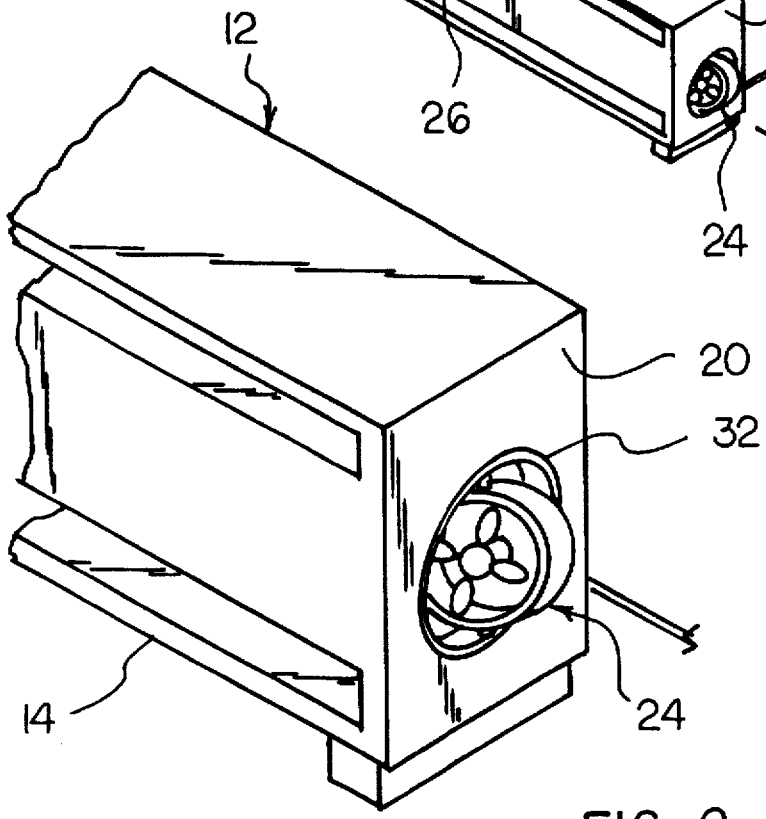
FIG 2

FIG 5
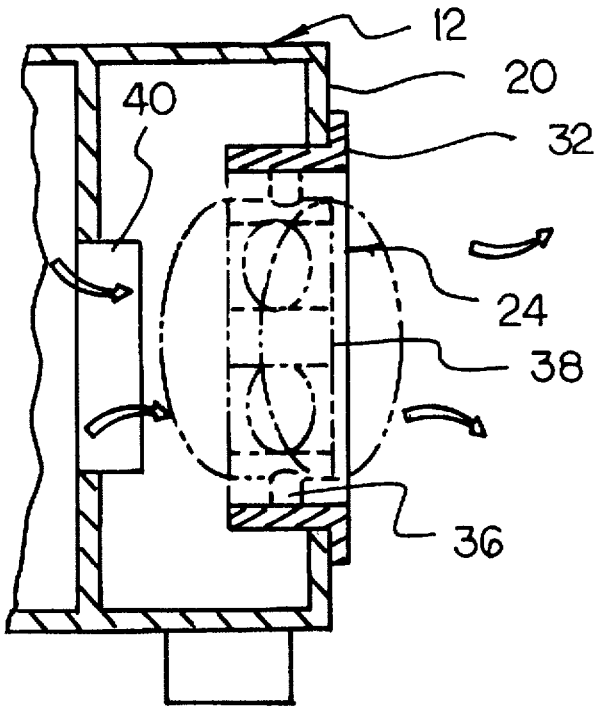
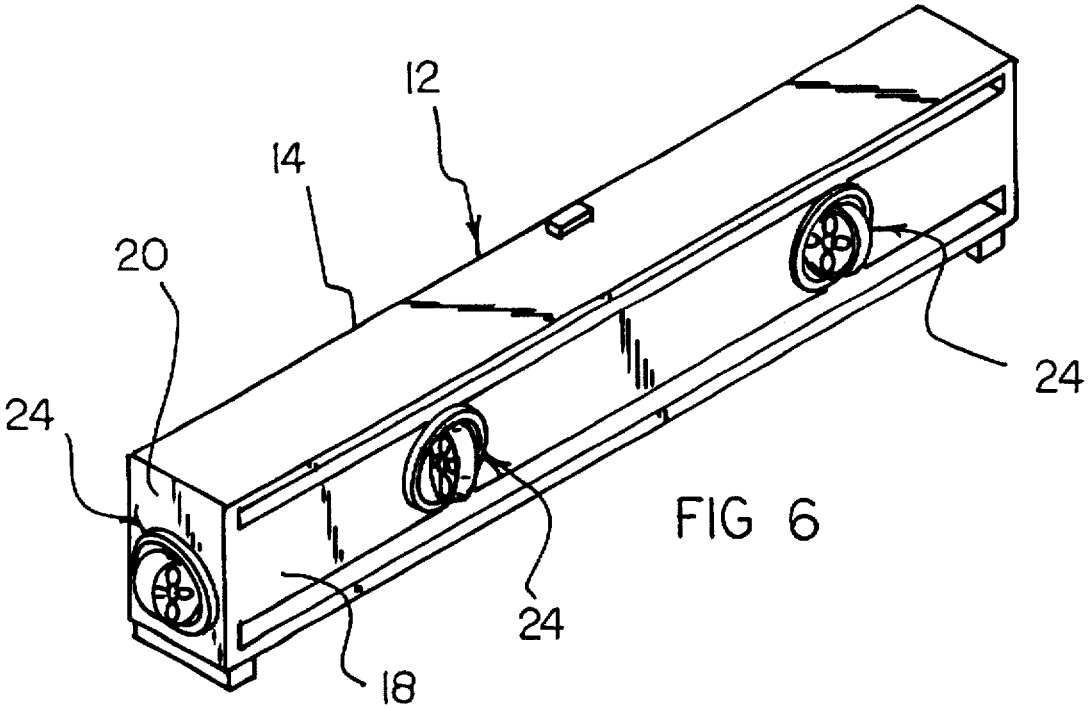
FIG 6

FORCED AIR BASEBOARD HEATER WITH PIVOTABLY MOUNTED FANS

BACKGROUND OF THE INVENTION

1. Field of the Invention

The present invention relates to heating devices and more particularly pertains to a forced air ventilated heater and dispensing air within a room.

2. Description of the Prior Art

The use of heating devices is known in the prior art. More specifically, heating devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art heating devices include U.S. Pat. No. 5,226,592; U.S. Pat. No. 5,121,788; U.S. Pat. No. 3,151,671; U.S. Pat. No. 5,245,691; U.S. Pat. No. 4,809,593; and U.S. Pat. No. 3,829,010.

While these devices fulfill their respective, particular objectives and requirements, the aforementioned patents do not disclose a forced air ventilated heater for heating and dispensing air within a room which includes a heater having a heating coil or radiator located within a housing, and fan assemblies mounted to end panels and/or front panels of the housing to force through the heater and into a room.

In these respects, the forced air ventilated heater according to the present inventions substantially departs from the conventional concepts and designs of the prior art, and in so doing provides an apparatus primarily developed for the purpose of heating and dispensing air within a room.

SUMMARY OF THE INVENTION

In view of the foregoing disadvantages inherent in the known types of heating devices now present in the prior art, the present invention provides a new forced air ventilated heater construction wherein the same can be utilized for heating and dispensing air within a room. As such, the general purpose of the present invention, which will be described subsequently in greater detail, is to provide a new forced air ventilated heater apparatus and method which has many advantages of the heating devices mentioned heretofore and many novel features that result in a forced air ventilated heater which is not anticipated, rendered obvious, suggested, or even implied by any of the prior art heating devices, either alone or in any combination thereof.

To attain this, the present invention generally comprises a heater for heating and dispensing air within a room. The inventive device includes a heater having a heating coil or radiator located within a housing. Fan assemblies are mounted to end panels, back panels and/or front panels of the housing to force air through the heater and into a room.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims nor is it intended to be limiting as to the scope of the invention in any way.

It is therefore an object of the present invention to provide a new forced air ventilated heater apparatus and method which has many of the advantages of the heating devices mentioned heretofore and many novel features that result in a forced air ventilated heater which is not anticipated, rendered obvious, suggested, or even implied by any of the prior art tool guides, either alone or in any combination thereof.

It is another object of the present invention to provide a new forced air ventilated heater which may be easily and efficiently manufactured and marketed.

It is a further object of the present invention to provide a new forced air ventilated heater which is of a durable and reliable construction.

An even further object of the present invention is to provide a new forced air ventilated heater which is susceptible of a low cost of manufacture with regard to both materials and labor, and which accordingly is then susceptible of low prices of sale to the consuming public, thereby making such forced air ventilated heaters economically available to the buying public.

Still yet another object of the present invention is to provide a new forced air ventilated heater which provides in the apparatuses and methods of the prior art some of the advantages thereof, while simultaneously overcoming some of the disadvantages normally associated therewith.

Still another object of the present invention is to provide a new forced air ventilated heater for heating and dispensing air within a room.

Yet another object of the present invention is to provide a new forced air ventilated heater which includes a heater having a heating coil or radiator located within a housing, and fan assemblies mounted to end panels and/or front panels of the housing to force through the heater and into a room.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a forced air ventilated heater according to the present invention.

FIG. 2 is an enlarged isometric illustration of a portion thereof.

FIG. 5 is a cross sectional view taken along line 5—5 of FIG. 4.

FIG. 6 is an isometric illustration of the invention including fan means mounted to a front panel of a heater of the invention.

DESCRIPTION OF THE PREFERRED EMBODIMENT

Figure 3:
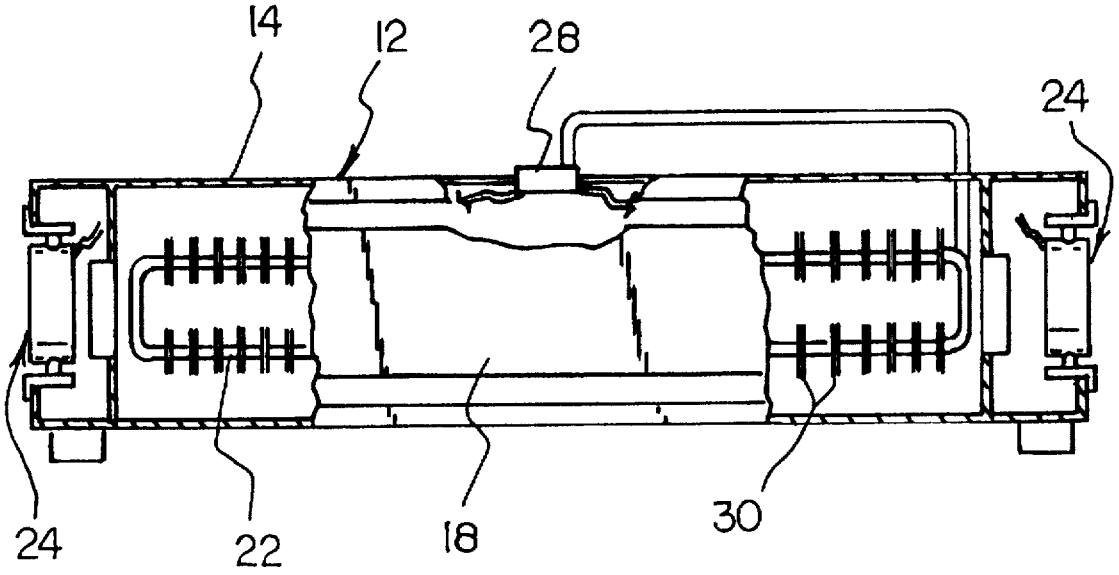
FIG. 3 is a front elevation view, partially in cross section, of the invention.

With reference now to the drawings, and in particular to FIG. 1–6 thereof, a new forced air ventilated heater embodying the principles and concepts of the present invention and generally designated by the reference numeral 10 will be described.

More specifically, it will note noted that the forced air ventilated heater 10 comprises a heater 12 including an elongated heater housing 14 which can be mounted within a room at a juncture of a wall and a floor substantially as shown in FIG. 1 of the drawings. The elongated heater housing 14 includes an elongated top panel 16 having a front panel 18 depending therefrom. Lateral end panels 20 of the elongated heater housing 14 extend along opposed longitudinal ends of the heater 12 and, as shown in FIG. 3, cooperate to enclose a heating coil 22 of the heater 12. Although the heater 12 of the present invention 10 is illustrated as a baseboard-type heater utilizing an electrical resistance heating coil 22 therein, it is within the intent and purview of the present invention for the heating coil 22 to comprise a steam radiator or other heat dispensing device. As shown in FIGS. 1 and 2, fan means 24 are mounted within apertures extending through the lateral end panels 20 and operate to draw air in through the elongated venting apertures 26 of the front panel 18, over the heating coil 22, and expel such air through the apertures in the lateral end panel 20. By this structure, ambient air surrounding the heater 12 is forcibly directed over the heating coil 22 so as to expedite and more efficiently heat such air during use of the device 10.

Referring now to FIGS. 2 through 5 wherein the present invention 10 is illustrated in detail, it can be shown that the present invention may further comprise a thermostat or thermal switch 28 positioned in electrical or effect of heat from the heater communication with the fan means 24 for energizing the fan means in response to a predetermined ambient temperature. The thermostat 28 may also be electrically coupled to the heating coil 22 so as to effect simultaneous operation thereof in conjunction with the fan means 24. Alternatively, the thermostat or thermal switch 28 can be electrically or hydraulically connected through tubes coupled only to the fan means 24, whereby the heating coil 22 operates independently of the fan means, with the thermostat 28 actuating the fan means only in response to an elevated temperature within the elongated heater housing 14 as generated by the heating coil 22. By this structure, the heating coil 22 may operate independently of the fan means 24, with the fan means being utilized when necessary as determined by the thermostat or thermal switch 28. As shown in FIG. 3, the heating coil 22 may include heating fins 30 extending therefrom which serve to increase an efficiency of thermal transferring of heat between the heating coil 22 and air passing thereover.

Figure 4:
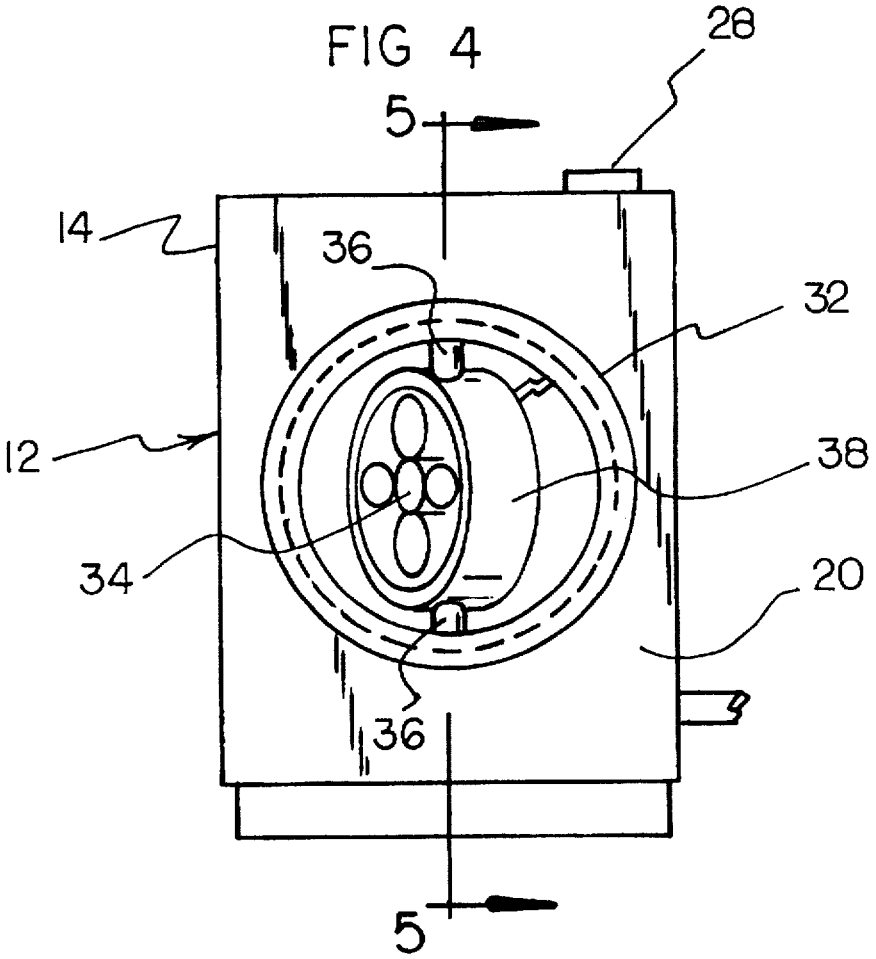
FIG. 4 is an end elevation view of the invention.

Referring now to FIGS. 2 and 4, with concurrent reference to FIG. 5, it can be shown that the fan means 24 of the present invention 10 each comprise a mounting collar 32 mounted within an aperture extending through the respective lateral end panels 20. An electric fan 34 is concentrically positioned within the mounting collar 32 and pivotally mounting collar 32 mounted within an aperture extending through the respective lateral end panels 20. An electric fan 34 is concentrically positioned within the mounting collar 32 and pivotally mounted therewithin by a pair of aligned pivot axles 36 which project from diametrically opposed exterior surfaces of a fan housing 38 of the electric fan 34 and are pivotally coupled to diametrically opposed interior surfaces of the mounting collar 32. By this structure, the electric fan 34 can be articulated about a vertical axis directed through the aligned pivot axles 36 so as to direct heated air from the device 10 in a desired direction. If desired, the mounting collar 32 can be rotatably mounted within the aperture extending through the respective lateral end panel 20 so as to permit rotational positioning of the aligned pivot axles 36 within a plane containing the lateral end panels 20. As shown in FIG. 5, a plurality of spaced and substantially parallel guide vanes 40 can be mounted within the heater housing 14 of the heater 12 in adjacency relative to the fan means 24 so as to concentrate and guide air from an interior of the heater housing for exhaustion by the fan means 24.

Referring now to FIG. 6, it can be shown that the present invention 10 may further comprise fan means 24 located within apertures extending through the front panel 18 of the heater housing 14. The fan means 24 can operate to pump air from exterior of the heater 12 into the elongated heater housing 14 for passage over the heating coil 22 therewithin and subsequent exhaustion from the fan means 24 of the lateral end panels 20. Alternatively, the fan means 24 located within the front panel 18 of the heater 12 may operate to exhaust air from the elongated heater housing 14 in a manner similar to that of the fan means 24 located within the lateral end panels 20.

In use, the forced air ventilated heater 10 according to the present invention can be easily utilized for supplying heated air within a room. The present invention 10 thus operates to more efficiently and quickly keep an associated room relative to conventionally know prior art baseboard heaters.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the part of the invention, to include variations in size, materials, shape, form, function and manner of operating, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A forced air ventilated heater comprising:

a heater including an elongated heater housing, the elongated heater housing including an elongated top panel having a front panel depending therefrom, and lateral end panels extending along opposed longitudinal ends of the heater;

an electric heating coil positioned within the housing of the heater;

fan means mounted within apertures extending through the lateral end panels for drawing air in through elongated venting apertures of the front panel, passing the air over the electric heating coil, and expelling the air through the apertures in the lateral end panels.

2. The forced air ventilated heater of claim 1, wherein the fan means comprises a pair of electric fans each having a fan housing and being mounted within the aperture of the respective lateral end panel.

3. The forced air ventilated heater of claim 2, wherein the fan means further comprises a pair of mounting collars with the electric fans each being concentrically positioned within an individual one of the mounting collars, each of the mounting collars being mounted within the aperture extending through the respective lateral end panel; and a pair of aligned pivot axles projecting from diametrically opposed exterior surfaces of the fan housing of the respective electric fan, with the axles being pivotally coupled to diametrically opposed interior surfaces of the respective mounting collar such that the electric fan can be articulated about an axis directed through the aligned pivot axles.

4. The forced air ventilated heater of claim 3, wherein the mounting collars are rotatably mounted within the aperture extending through the respective lateral end panel so as to permit rotational positioning of the aligned pivot axles within a plane containing the respective lateral end panel.

5. The forced air ventilated heater of claim 4, and further comprising additional fan means located within apertures extending through the front panel of the heater housing.

6. The forced air ventilated heater of claim 5, wherein the additional fan means comprises a pair of additional electric fans each having an additional fan housing and being mounted within the respective aperture of front panel.

7. The forced air ventilated heater of claim 6, wherein the additional fan means further comprises a pair of additional mounting collars with the additional electric fans each being concentrically positioned within an individual one of the additional mounting collars, each of the additional mounting collars being mounted within the respective aperture extending through the front panels; and a pair of aligned additional pivot axles projecting from diametrically opposed exterior surfaces of the additional fan housing of the respective electric fan, with the additional pivot axles being pivotally coupled to diametrically opposed interior surfaces of the respective additional mounting collar such that the additional electric fan can be articulated about an axis directed through the aligned additional pivot axles.

8. The forced air ventilated heater of claim 7, wherein the additional mounting collars are rotatably mounted within the respective aperture extending through the front panel so as to permit rotational positioning of the aligned additional pivot axles within a plane containing the front panel.

9. The forced air ventilated heater of claim 8, and further comprising a thermostat positioned in electrical communication with the fan means for energizing the fan means in response to a predetermined ambient temperature.

10. The forced air ventilated heater of claim 9, wherein the thermostat is further electrically coupled to the heating coil for effecting simultaneous operation of the heating coil with the fan means.

11. The forced air ventilated heater of claim 10, wherein the thermostat is further electrically coupled to the additional fan means.

12. The forced air ventilated heater of claims 2, 3, 5, 6 and 7 wherein the fan or fans can be operated by means of steam or hot water when the heating coil is operated by means of steam or hot water.

13. The forced air ventilated heater of claims 9 and 10 wherein the thermostat is a thermal switch connected by metal or plastic tubing to the heating coil when the heater is operated by means of steam or hot water.

14. The forced air ventilated heater of claim 1, wherein the heater is a baseboard heater.

15. The forced air ventilated heater of claim 1, wherein the heater is a baseboard heater being mounted to a structure at an intersection of a wall and a floor.

* * * * *